US005585825A

United States Patent [19]

Kneezel et al.

[11] Patent Number: 5,585,825

[45] Date of Patent: Dec. 17, 1996

[54] INK JET PRINTER HAVING TEMPERATURE SENSOR FOR REPLACEABLE PRINTHEADS

[75] Inventors: Gary A. Kneezel; Robert V. Lorenze, both of Webster; Thomas P. Courtney, Fairport; Thomas J. Wyble; Joseph J. Wysocki, both of Webster; Richard V. LaDonna, Fairport; Juan J. Becerra, Webster; Thomas E. Watrobski, Penfield, all of N.Y.

[73] Assignee: Xerox Corporation, Stamford, Conn.

[21] Appl. No.: 345,046

[22] Filed: Nov. 25, 1994

[51] Int. Cl.[6] ..... B41J 29/38

[52] U.S. Cl. ..... 347/14; 347/17; 347/49

[58] Field of Search ..... 347/14, 17, 23, 347/31, 49, 56, 59, 63, 87, 108, 65; 400/56, 124.03; 361/719, 720; 374/141

[56] References Cited

U.S. PATENT DOCUMENTS

| | | | |
|---|---|---|---|
| 4,571,599 | 2/1986 | Rezanka | 346/140 R |
| 4,709,245 | 11/1987 | Piatt | 347/49 |
| 4,744,530 | 9/1988 | Hawkins | 346/140 R |
| 4,899,180 | 2/1990 | Elhatem | 346/140 R |
| 4,980,702 | 12/1990 | Kneezel et al. | 346/140 R |
| 5,075,690 | 12/1991 | Kneezel | 346/1.1 |
| 5,107,276 | 4/1992 | Kneezel et al. | 346/1.1 |
| 5,137,377 | 8/1992 | Ito et al. | 400/56 |
| 5,223,853 | 6/1993 | Wysocki et al. | 346/1.1 |
| 5,289,212 | 2/1994 | Carlotta | 346/140 R |
| 5,343,230 | 8/1994 | Dietl | 346/31 |

*Primary Examiner*—John E. Barlow, Jr.
*Assistant Examiner*—L. Anderson

[57] ABSTRACT

An ink jet printer has a temperature sensor as a permanent part thereof. The temperature sensor is mounted on the translatable carriage of the printer. A replaceable printhead cartridge having a printhead bonded to a heat sink is installed on the translatable carriage. Once the printhead cartridge is installed on the translatable carriage, the temperature sensor is placed into intimate contact with printhead'heat sink, so that the temperature sensor moves with the printhead and provides continual temperature measurement.

5 Claims, 3 Drawing Sheets

INK JET PRINTER HAVING TEMPERATURE SENSOR FOR REPLACEABLE PRINTHEADS

BACKGROUND OF THE INVENTION

This invention relates to thermal ink jet printers and more particularly to a thermal ink jet printer having a temperature sensor as a permanent part of the ink cartridge receiving carriage, so that the temperature of the printheads of replaceable ink cartridges may be continually monitored.

The ink droplet ejecting performance of thermal ink jet printheads is temperature dependent. As temperature increases, so does the volume of the ink ejected. Moreover, at sufficiently high temperatures, air ingestion causes unreliable droplet ejection, leading to missing ink spots on the recording medium. Methods have been devised to compensate for printhead temperature variations and the thermal effects created by the temperature variations. These methods include modifying the electrical pulses to the droplet ejecting heating elements in response to the temperature of the printhead to keep the droplet volume and thus spot size more constant regardless of printhead temperature and also to suppress air ingestion. The electrical pulses are generally modified by varying the electrical pulse width and/or amplitude. Another method to compensate for thermal effects on printheads includes applying heat to the printhead when it is too cold, such as, by applying subthreshold pulses to the heating elements which are not capable of ejecting droplets. Most of the methods for compensating for printhead thermal effects require an accurate measurement of printhead temperature. One known method of providing a temperature reading for a printhead is to fabricate a temperature sensor or measuring device, such as a thermistor, directly on the thermal ink jet printhead die. The fabrication is economical, but in some applications it may be difficult to have a known thermal response of the sensor without calibrating each part. Another method is to bond a temperature measuring device directly to the printhead. In some applications, such as, for example, in printers which use disposable printhead cartridges, it is not economical to bond a sensor to each printhead. It is more economical to incorporate a permanent temperature measuring device into the printer, so that it is not thrown away each time the cartridge with the printhead is disposed. Generally, such a temperature measuring device in the printer is only capable of measuring ambient printer temperature, because the temperature measuring device does not contact the printhead. There is significant self-heating in a thermal ink jet printhead, so that the printhead temperature is somewhat different than ambient temperature. Thus, temperature prediction algorithms must be used based on ambient temperature and the printhead usage rate, whenever the ambient printer temperature is used. However, it is not easy to make such algorithms quantitatively accurate for all usage and ambient conditions.

U.S. Pat. No. 4,899,180 to Elhatem, et al. discloses an ink jet printhead having integrated into it a number of heating elements and a temperature regulating circuit to heat the printhead to its optimum operating temperature within seconds of turn-on and thereafter maintain that temperature.

U.S. Pat. No. 4,980,702 to Kneezel et al. discloses a printhead bonded to a heat sinking substrate having a recess formed therein. Two layers of resistive material, separated from each other by a dielectric layer, are formed in the recess by a thick film screen print process which functions respectively as a heater and a temperature sensor. The recess underlies the printhead which is bonded to the substrate. The arrangement provides good proximity of the heater and the temperature sensor to the printhead, thereby enabling accurate temperature measurements and efficient printhead heating.

U.S. Pat. No. 5,075,276 to Kneezel discloses an ink jet printhead fabricated with a resistive temperature sensor formed adjacent the heating elements. In the preferred embodiment, the sensor and heating elements are the same material. The resistive value of the sensor is established by a trimming operation while the printhead is at a specified set temperature. This technique provides the accuracy of the sensor or thermistor required which was otherwise not possible when the thermistor was formed in close proximity to the printhead and of the same material as the heating elements.

U.S. Pat. No. 5,107,276 to Kneezel et al. discloses a thermal ink jet printer having a printhead maintained at a substantially constant operating temperature during printing. Printhead temperature fluctuations are prevented by selective heating of the heating elements not being used to eject droplets with energy pulses having insufficient magnitude to eject droplets.

U.S. Pat. No. 5,223,853 to Wysocki et al. discloses a method of controlling the spot sizes printed by a thermal ink jet printer. The temperature of the ink in the printhead is sensed and a combination of power level and time duration of the electrical input signal to the heating elements is selected by entering the sensed temperature of the ink into a predetermined function relating to the energy of the input signal to the corresponding resulting size of the spot on the copy sheet.

SUMMARY OF THE INVENTION

It is an object of the present invention to incorporate a temperature measuring device or sensor into a thermal ink jet printer as a permanent part thereof which makes good thermal contact with the printhead of a replaceable cartridge when the cartridge is installed in the cartridge carriage for concurrent translation therewith.

In the present invention, an ink jet printer has a temperature sensor as a permanent part thereof to measure the temperature of printheads which are an integral part of a replaceable cartridge. The temperature sensor is a part of the printer carriage into which the replaceable cartridges are placed so that the temperature of the printheads is continually sensed once the cartridges are installed. In the preferred embodiment, the temperature sensor is spring-loaded and is located in the fixed wall of the printer carriage, and a sliding connector in which a replaceable printhead cartridge is mounted is manually moved into locking contact with the fixed wall, so that as a cartridge is installed in the printer carriage, the wall with the temperature sensor places the sensor into intimate contact with the printhead's heat sink and enables continual temperature measurements thereof. To facilitate good thermal contact, a recess is provided in the heat sink upon which the printhead resides for entry by and seating of the spring-loaded temperature sensor.

A more complete understanding of the present invention can be obtained by considering the following detailed description in conjunction with the accompanying drawings, wherein like parts have like index numerals.

DESCRIPTION OF THE PREFERRED EMBODIMENT

Figure 1:
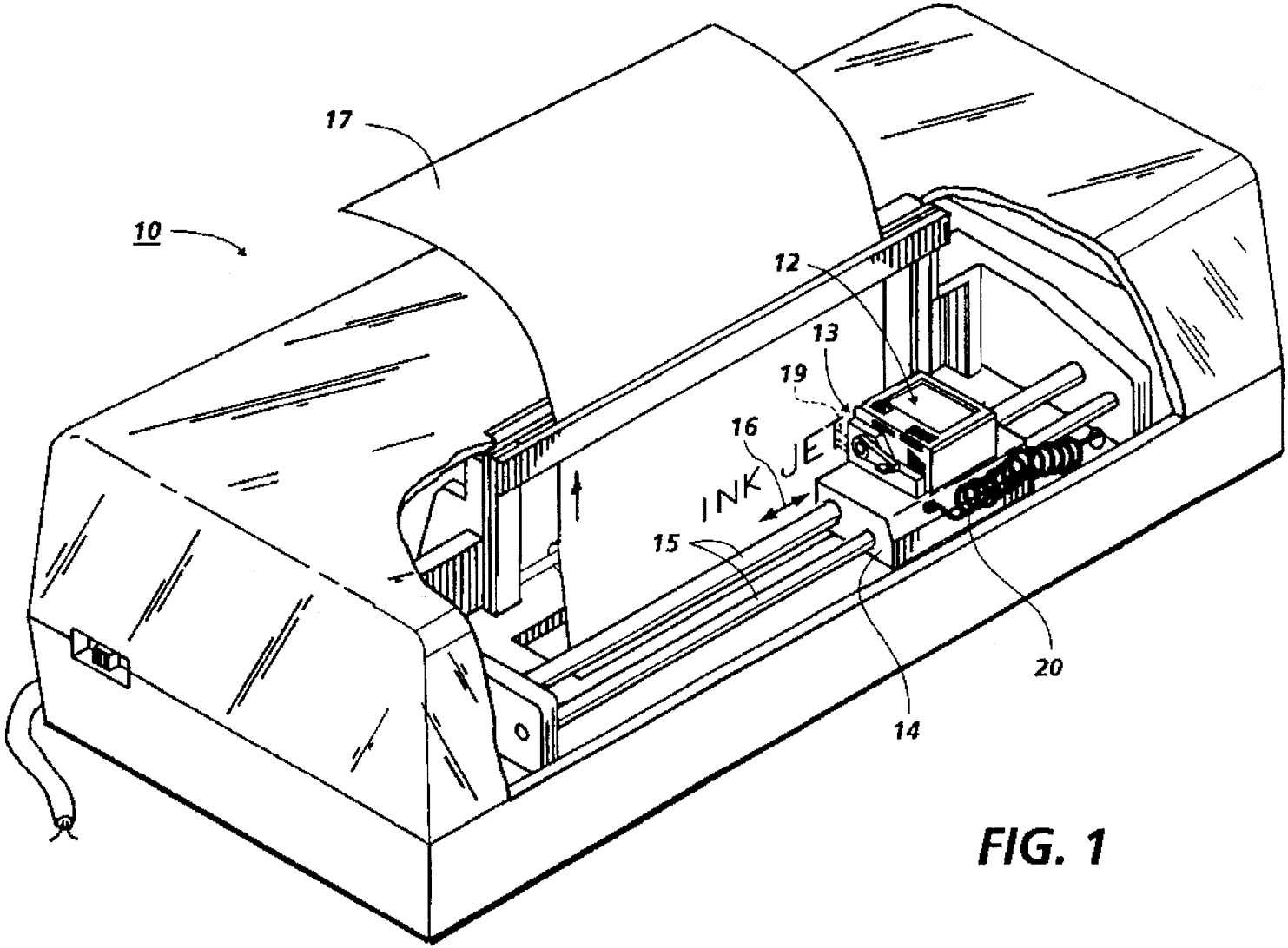
FIG. 1 is a schematic isometric view of a partially shown ink jet printer showing a replaceable printhead cartridge on a translatable carriage of the present invention, incorporating the spring-loaded temperature sensor.

The thermal ink jet printer 10 shown in FIG. 1 has a replaceable printhead cartridge 12 removably mounted on a translatable carriage 14. During the printing mode, the carriage reciprocates back and forth on guide rails 15 as depicted by arrow 16. A recording medium 17, such as, for example, paper, is held stationary while the carriage is moving in one direction and, prior to the carriage moving in the reverse direction, the recording medium is stepped a distance equal to the height of a stripe or swath of data printed on the recording medium by the ink jet printhead die assembly 18 (not shown in FIG. 1), which is attached to and in fluid communication with the cartridge. Each printhead die assembly has a linear array of nozzles (not shown) which are aligned substantially perpendicular to the reciprocating direction of the carriage. The nozzles confront the recording medium and are spaced therefrom a distance of about 0.04 inches. In one embodiment, the center-to-center between nozzles is about 3 mils, so that 300 spots or pixels per inch may be printed on the recording medium 17. The thermal ink jet printhead, such as that described in U.S. Pat. No. 4,774,530 and U.S. Pat. No. 4,571,599, both incorporated herein by reference, ejects ink droplets 19 toward the recording medium during the traversal of the carriage 14 to print information thereon. The electrical signal carrying ribbon cable 20 connects the terminals (not shown) in the cartridge holder 13 to the controller (not shown) and power supply (not shown) of the printer 10. Insertion of the cartridge 12 into the cartridge holder 13 automatically connects the terminals (not shown) of the printed circuit board 22 (see FIG. 3) to mating terminals (not shown) in the cartridge holder. The various electrical terminals are not a part of this invention and are omitted for clarity. Any suitable interconnecting terminals will suffice and are well known in the ink jet printing industry.

Figure 2:
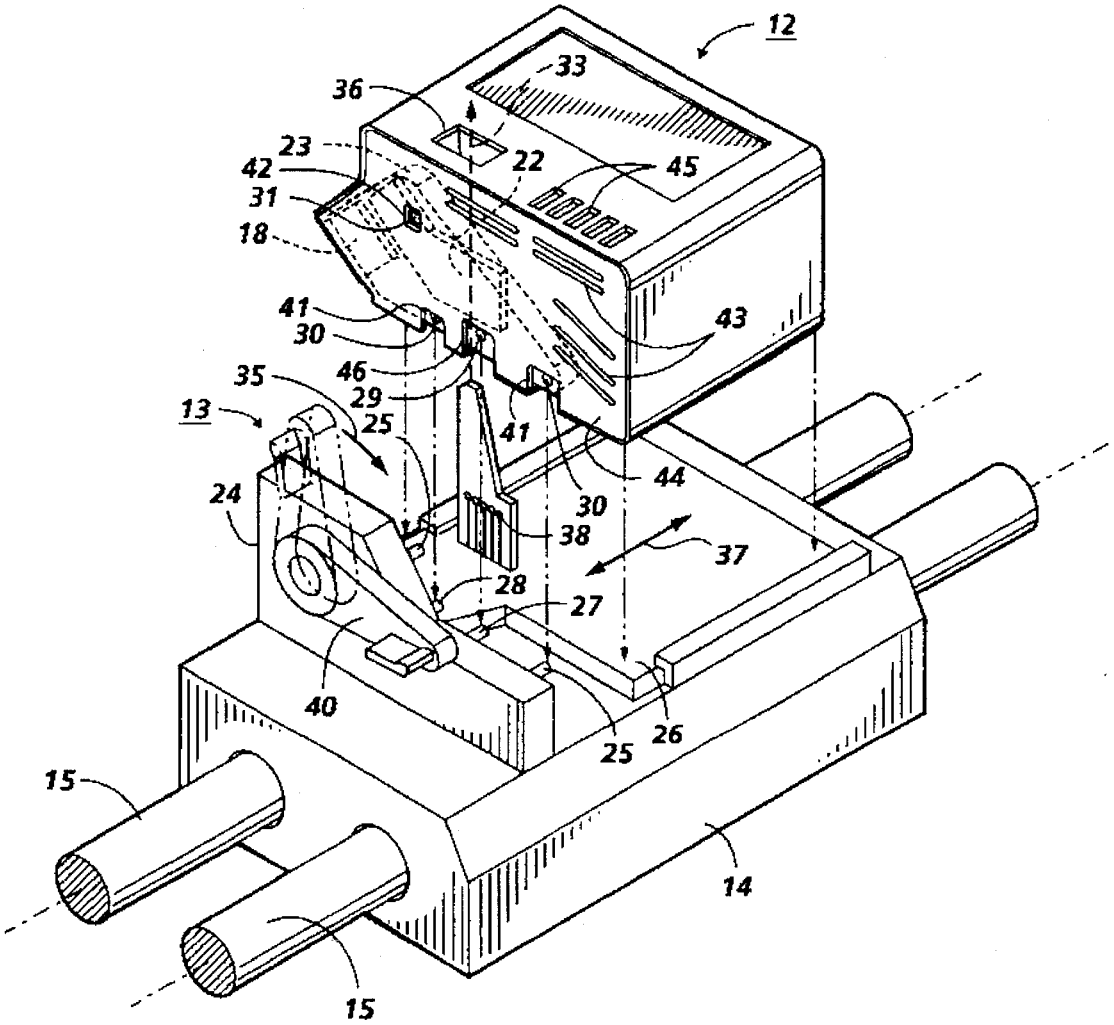
FIG. 2 is an isometric, exploded view of the replaceable cartridge and translatable carriage which contains the spring-loaded temperature sensor.

Referring to FIG. 2, the translatable carriage 14 has mounted thereon a cartridge holder 13 comprising a fixed datum plate 24 attached near an end of the carriage 14. The fixed datum plate 24 provides accurate positioning features 25,27 for aligning the cartridge 12 and sliding connector plate 26 to carriage 14. The fixed datum plate includes multiple datum features 25,27, such as alignment projections, which mate with corresponding datum features, such as holes 30,31 located in the substrate 23 which holds the printhead die assembly 18 and printed circuit board 22 and is fixed to the cartridge by staked pins 32 (see FIG. 3) and adhesive (not shown). One of the functions of the printhead substrate 23 is to remove heat from the die assembly 18, and substrate 23 may be referred to as heat sink 23. For a more detailed description of the cartridge, refer to U.S. Pat. No. 5,289,212 incorporated herein by reference.

The sliding connector plate 26 has a vertical supporting post 34. When the cartridge 12 is installed on the sliding connector plate 26, an opening 36 in the cartridge receives the supporting post, as indicated by arrow 33. The supporting post is then located between the bottom of the cartridge and the heat sink 23 and mechanically connects the cartridge to the supporting post, while concurrently electrically connecting the printed circuit board 22 on the heat sink 23 with electrode terminals 38 on the supporting post. For a more detailed explanation how this is accomplished, refer to U.S. Pat. No. 5,343,230, which patent is incorporated herein by reference.

The cartridge holder 13 is provided with a latch mechanism 40 which, when closed in the direction of arrow 35, moves the sliding connector plate with cartridge thereon towards datum plate 24, as indicated by arrow 37, and maintains the sliding connector plate 26 and cartridge thereon fixedly attached to the carriage 14. To facilitate insertion or removal of the cartridge 12, the latch mechanism 40 is opened to the position shown in dashed line. When the latch mechanism is opened, the sliding connector plate 26 is slidably moved a short distance away from the datum plate 24. This movement, which may be on the order of 10 mm, releases the sliding connector plate 26 from contact with the fixed datum plate 24 and unplugs datum features or projections 25,27 from holes 30,31 in the heat sink 23. Opening 41,42 in the bottom cover 44 of the cartridge exposes the heat sink portion containing the holes 30,31 therein. Engagement of the datum features into the heat sink holes precisely align the heat sink, cartridge, and connector plate with the datum plate. For ventilation and heat management assistance, the bottom cover 44 also has elongated apertures 43 and the bottom portion of the cartridge has elongated apertures 45 located between the heat sink and the cartridge.

The opening of the latch mechanism 40 causes the disconnection of the printed circuit board from the electrode terminals on the supporting post, and closing the latch mechanism reconnects the printed circuit board and electrode terminals on the supporting post, thus making power available to the printhead from the printer controller.

The spring-loaded temperature sensor 28 of the present invention is contained on the datum plate 24, so that the sensor is biased toward the cartridge heat sink 23. Another opening 46 in the bottom cover 4 exposes a portion of the heat sink containing recess 29 which is aligned with the sensor 28. When the latch mechanism 40 is closed to engage the datum features 25,27 with the mating holes 30,31 in the heat sink and connect the printed circuit board to the electrodes on the supporting post 34, the distal end of the sensor is seated into the heat sink recess 29. So long as the latch mechanism is closed, the cartridge is available to print and the temperature sensor 28 may continually sense the temperature of the heat sink 23.

Figure 3:
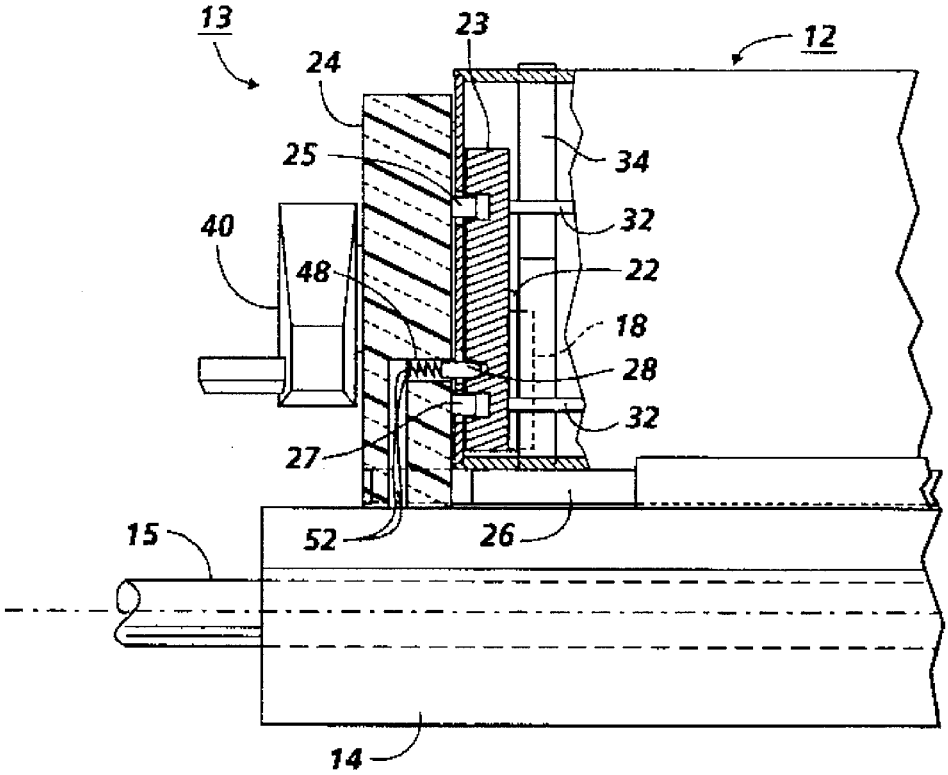
FIG. 3 is a partially shown cross-sectional view of the translatable carriage with replaceable cartridge installed thereon, which shows the spring-loaded temperature sensor seated in the recess of the heat sink for the printhead which is bonded thereto.
Figure 4:
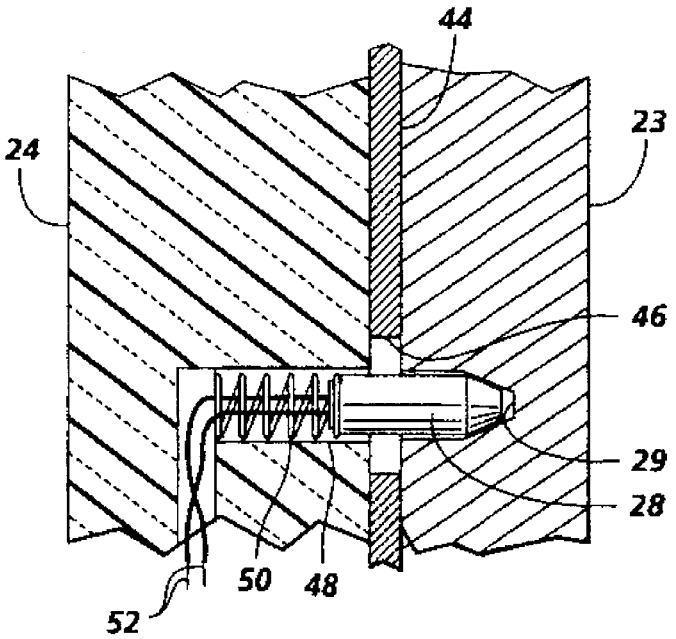
FIG. 4 is an enlarged view of the temperature sensor seated in the heat sink recess as shown in FIG. 3.

Referring to FIGS. 2, 3 and 4, the cartridge 12 is shown locked into place on the cartridge holder 13, with the datum features or projections 25,27 of the datum plate 24 in locking engagement with the mating holes 30,31 in the heat sink 23. In this position, the spring-loaded temperature sensor 28 resides in a circular recess 48 in the datum plate and a spring 50 in the circular recess 48 urges the temperature sensor 28 in a direction parallel with and away from the recess 48 and into intimate contact with recess 29 in the heat sink 23. Electrical leads 52 connect to the printer controller, which monitors the temperature of the heat sink and thus the printhead 18. The controller may be used to adjust the current pulses to the printhead heating elements (not shown) to maintain a substantially constant droplet size by means well known in the art. FIG. 4 is an enlarged cross-sectional view of the portion of FIG. 3 containing the spring-loaded temperature sensor and showing the temperature sensor engaged in recess 29 of the heat sink 23. Typical temperature sensors suitable for this application include, among others, thermistors and thermocouples.

To assure good thermal contact, the distal end of the temperature sensor is tapered and the recess 29 in the heat sink 23 has a complementary shape to cause an interference contact. This interference contact and complementary shapes provide for more surface area contact between the two and a more accurate temperature measurement. Optionally, a thermal grease or similar heat transfer assisting medium (not shown) is used to improve the thermal contact between the temperature sensor and the recess in the heat sink. The temperature sensor is a permanent part of the cartridge holder on the translatable carriage and thus a permanent part of the printer. When a replaceable cartridge is installed, the temperature sensor moves with the printhead, continually measuring the temperature of the heat sink upon which the printhead is bonded and provides continual signals representative of the heat sink temperature to the printer controller for use thereby in adjusting the electrical pulses to the printhead heating elements and enabling the ejection of droplets with substantially uniform size.

Although the prior discussion centers on the case of a temperature sensor mounted on datum plate 24, alternative locations are on the supporting post 34 or the sliding connector plate 26. Also, there can be multiple temperature sensors which are brought into contact with multiple printhead substrates—for example, for a color printhead assembly. Furthermore, the means of actuating the temperature sensor into intimate contact with the printhead is not restricted to be spring-loaded or an integral part of the latching mechanism, but may be other actuable mechanisms, such as solenoids or cams. The key idea is that the temperature sensors are a permanent part of the printhead mounting assembly (such as the cartridge holder on a translatable carriage) and that the sensors are brought into intimate thermal contact with the corresponding replaceable printheads when the printheads are mounted into the printer.

Many modifications and variations are apparent from the foregoing description of the invention and all such modifications are intended to be within the scope of the present invention.

We claim:

1. An ink jet printer having a reciprocating carriage movable across a printing zone, the printer including:

a cartridge holder mounted on the reciprocating carriage, at least one ink supply cartridge with an integrally mounted thermal printhead bonded to at least one heat sink substrate forming an integral part thereof, at least one temperature sensor mounted on said cartridge holder and latching means for latching said at least one ink supply cartridge into an operative printing location in said cartridge holder, said latching means including means for biasing said at least one temperature sensor into intimate contact with said at least one heat sink substrate.

2. The printer of claim 1 wherein said cartridge holder has a fixed datum member with datum features thereon, a movable connector plate and a latch mechanism on the datum member for moving the connector plate towards said datum member when a printhead cartridge is locked into said printing location and wherein said temperature sensor is fixedly mounted on the datum member of the cartridge holder, so that locking of the ink supply cartridge in the cartridge holder causes the temperature sensor to be brought into said intimate contact with said at least one heat sink substrate.

3. The printer of claim 2 wherein said at least one heat sink substrate has a recess in one surface and wherein the temperature sensor has a distal end which is seated into said recess when said cartridge is locked into said printing location.

4. The printer of claim 1, wherein said at least one ink supply cartridge is replaceable.

5. A temperature control system for an ink jet printer which includes an ink jet printhead bonded to a heat sink substrate, said ink jet printhead and said heat sink substrate being mounted to a printhead mounting assembly, the control system including, in combination, a temperature sensor for sensing the temperature of the printhead, said temperature sensor being mounted on said printhead mounting assembly, electrical control means responsive to outputs from said temperature sensor to adjust electrical pulses to the printhead and biasing means for selectively urging the temperature sensor into intimate contact with said heat sink substrate said biasing means being mounted on said printhead mounting assembly.

* * * * *